United States Patent [19]

Moriarty, Jr.

[11] Patent Number: 4,590,418

[45] Date of Patent: May 20, 1986

[54] CIRCUIT FOR GENERATING A TEMPERATURE STABILIZED REFERENCE VOLTAGE

[75] Inventor: John K. Moriarty, Jr., Gaithersburg, Md.

[73] Assignee: General Motors Corporation, Detroit, Mich.

[21] Appl. No.: 668,427

[22] Filed: Nov. 5, 1984

[51] Int. Cl.[4] ..... G05F 3/30

[52] U.S. Cl. ..... 323/313; 323/314; 323/907

[58] Field of Search ..... 323/311, 313, 314, 907; 307/297

[56] References Cited

U.S. PATENT DOCUMENTS

| | | | |
|---|---|---|---|
| 3,886,435 | 5/1975 | Steckler | 307/297 |
| 4,100,436 | 7/1978 | Van De Plassche | 307/297 |
| 4,263,519 | 4/1981 | Schade | 307/297 |
| 4,317,054 | 2/1982 | Caruso et al. | 307/297 |
| 4,460,856 | 7/1984 | Bynum et al. | 323/313 |

OTHER PUBLICATIONS

Ye et al., "Bandgap Voltage Reference Sources in CMOS Technology", Electronic Letters, vol. 18, No. 1, pp. 24, 25, Jan. 7, 1982.

*Primary Examiner*—William H. Beha, Jr.
*Attorney, Agent, or Firm*—Howard N. Conkey

[57] ABSTRACT

A CMOS integrated circuit for providing a temperature stabilized reference voltage includes a pair of common collector transistors operated to produce a voltage having one component based on the positive temperature coefficient difference in the base-emitter junction voltages of the transistors and a second component based on the negative temperature coefficient voltage developed from the base-emitter junction voltage of one of the transistors.

1 Claim, 1 Drawing Figure

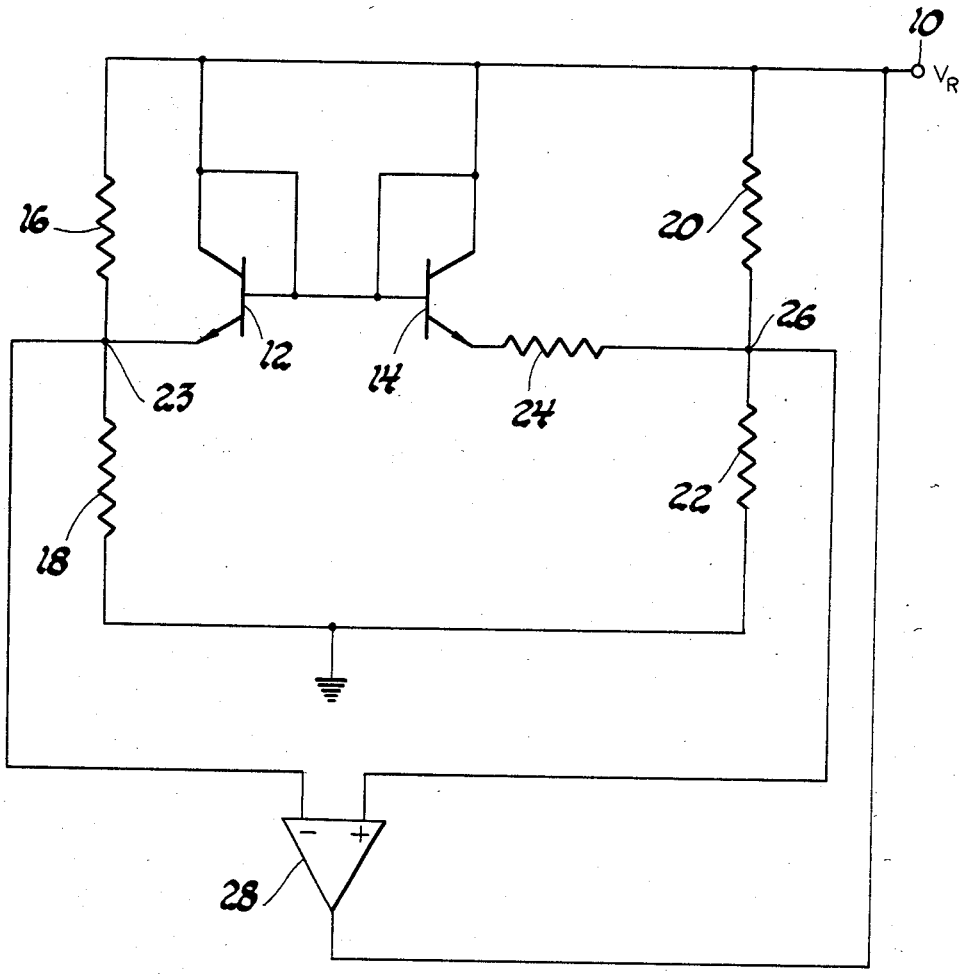
10
$V_R$
16
20
12
14
26
23
24
22
18
28
−
+

CIRCUIT FOR GENERATING A TEMPERATURE STABILIZED REFERENCE VOLTAGE

This invention relates to an integrated circuit for producing a constant temperature-stabilized output reference voltage. More particularly, the invention relates to an infinitely variable band gap voltage reference circuit compatible with CMOS integrated circuits for providing a precise temperature-stabilized reference voltage.

In many circuit applications such as in voltage supplies, constant voltage references are often required. Typically, it is desirable to provide for a reference voltage that has an absolute known magnitude that is substantially independent of temperature variations. Band gap reference circuits have been developed in integrated circuitry in which the fundamental electronic properties of the semiconductor material are employed to develop a temperature-stabilized reference voltage. The principle in these voltage reference circuits is that by combining the base-to-emitter voltage of one transistor with the difference in the base-to-emitter voltages of two transistors operating at different current densities, a temperature-stabilized reference voltage may be provided. The base-to-emitter voltage has a negative temperature coefficient while the difference in the base-to-emitter voltages has a positive temperature coefficient. By properly scaling the two voltage terms, the positive and negative temperature coefficient terms can be balanced to provide a temperature insensitive voltage reference.

Typically, voltage reference circuits employing the band gap principle require transistors having isolated collectors so that the circuits are not suitable for conventional CMOS processing. Further, band gap voltage reference circuits typically require compensation for the non-zero base currents in the transistors in order to provide a stabilized reference voltage.

The subject invention provides for an infinitely variable band gap voltage reference circuit suitable for fabrication on CMOS integrated circuits and which does not require base current compensation to provide the stabilized output reference voltage.

The invention may be best understood by reference to the single figured drawing which is a circuit diagram of a band gap voltage reference circuit illustrating the principles of this invention.

Referring to the drawing, the integrated circuit for providing a temperature-independent reference voltage at an output terminal 10 employs a pair of common collector NPN transistors 12 and 14. These transistors are operated at different current densities thereby establishing a difference in their respective base emitter junction voltages, the difference having a positive temperature coefficient. A voltage derived from this difference in base emitter voltages is summed with a voltage derived from the negative temperature coefficient base emitter junction voltage of one of the transistors to provide the reference voltage $V_R$.

In the present embodiment, the bases and collectors of the transistors 12 and 14 are all coupled to the output terminal 10 so that the collector and bases of each of the transistors are at the same potential. In another embodiment, however, the collectors of the transistors 12 and 14 are not coupled to the output terminal 10 but instead are coupled to and biased by a voltage source to a voltage V+.

Two resistors 16 and 18 are series coupled between the collectors of the transistors 12 and 14 and ground potential. Similarly, two resistors 20 and 22 are series coupled between the collectors of the transistors 12 and 14 and ground potential. The emitter of the transistor 12 is coupled to the node 23 between the resistors 16 and 18 and the emitter of the transistor 14 is coupled to the node 26 between the resistors 20 and 22 through a resistor 24. The nodes 23 and 26 are coupled to the negative and positive inputs respectively of a differential amplifier 28 whose output is coupled to the output terminal 10 and the collector and bases of the transistors 12 and 14. This feedback voltage comprises the reference voltage $V_R$ output of the integrated circuit.

In operation, the output of the differential amplifier 28 comprises a feedback voltage for biasing the transistors 12 and 14 conductive to a state at which the nodes 23 and 26 are at equal potentials. In the present embodiment, the resistors 16 and 20 are equal and the resistors 18 and 22 are equal so that the transistors at this operating point are each operated at different current densities determined by the difference in their emitter areas. For example, in the present embodiment, the transistor 12 has an emitter area equal to A and the transistor 14 has an emitter area equal to NA. When so operated at different current densities, a difference exists between the base-emitter junction voltages of the transistors 12 and 14. This difference in base-emitter junction voltages is sensed by the resistor 24. As previously described, this voltage across the resistor 24 has a positive temperature coefficient.

When the transistors are biased by the output of the differential amplifier 28 so that the nodes 23 and 26 are at equal potentials, the voltage across the resistor 20 equals the voltage across the resistor 16. Since the resistor 16 is coupled in parallel with the base and emitter of the transistor 12, the voltage across the resistor 20 is equal to the base-emitter junction voltage of the transistor 12. This voltage, as previously described, has a negative temperature coefficient.

With the transistors 12 and 14 biased by the amplifier 28 so that the nodes 23 and 26 are at equal potentials, the current $I_{R24}$ through the resistor 24 having a resistance $R_{24}$ is defined by the expression $$I_{R24}=(V_{be2}-V_{be1})/R_{24} \quad (1)$$

where $V_{be1}$ is the base-emitter junction voltage of the transistor 12 and $V_{be2}$ is the base-emitter junction voltage of the transistor 14. The current $I_{R20}$ through the resistor 20 having a resistance $R_{20}$ is defined by the expression $$I_{R20}=V_{be1}/R_{20}. \quad (2)$$

Since the differential amplifier 28 has a very large input impedance, the current $I_{22}$ through the resistor 22 having a resistance $R_{22}$ is equal to the sum of the currents $I_{R20}$ and $I_{R24}$. The resulting voltage $V_{R20}$ across the resistor 22 having a resistance $R_{22}$ is defined by the expression $$V_{R22}=V_{be1}R_{22}/R_{20}+(V_{be2}-V_{be1})R_{22}/R_{24}. \quad (3)$$

The voltage at the output terminal 10 comprising the regulated voltage $V_R$ is the sum of the voltages across the resistor 20 and the resistor 22. This voltage is defined by the expression $$V_R = K_1 V_{be1} + K_2(V_{be2} - V_{be1}) \quad (4)$$

where $K_1$ is a factor equal to $1+R_{22}/R_{20}$ and $K_2$ is a factor equal to $R_{22}/R_{24}$.

As can be seen from expression (4), $V_R$ is comprised of one voltage component based on the negative temperature coefficient base-emitter junction voltage $V_{be1}$ of the transistor 12 and a second component based on the positive temperature coefficient difference between the base-emitter junction voltages of the transistors 12 and 14. By proper selection of the scaling factors $K_1$ and $K_2$, the positive temperature coefficient may be made to exactly balance the negative temperature coefficient to produce a temperature insensitive reference voltage $V_R$ at the output terminal 10. This condition is established by selecting the value of the resistors 20, 22 and 24 so that the voltage $V_R$ at the output terminal 10 is equal to $K_1V_{go}$, where $V_{go}$ is the semiconductor band gap voltage extrapolated to absolute zero. By selecting the resistance values $R_{22}$ and $R_{20}$, the ratio $R_{22}/R_{20}$ and therefore $K_1$ may be made any desired value greater than 1 to establish any desired value of VR greater than the band gap voltage Vgo.

The foregoing circuit is capable of providing a temperature insensitive output reference voltage infinitely variable above the band gap voltage in a CMOS integrated circuit. Further, the circuit does not require base current compensation since only the emitter currents of the transistors 12 and 14 enter into the development of the temperature insensitive reference voltage $V_R$.

The detailed description of the preferred embodiment of this invention for the purposes of explaining the principles thereof is not to be considered as limiting or restricting the invention since many modifications may be made by the exercise of skill in the art without departing from the scope of the invention.

The embodiments of the invention in which an exclusive property or privilege is claimed are defined as follows:

1. A monolithic integrated circuit for producing a temperature independent output voltage $V_R$, comprising:

first and second matched bipolar junction transistors each having a base coupled together and to a reference voltage node, a collector and an emitter;

a first resistor coupled between the emitter of the first transistor and a common voltage node;

second and third resistors series coupled between the reference voltage node and the common voltage node; and means for biasing the first and second transistors conductive including feedback means for providing a feedback voltage to the reference voltage node to establish respective base-emitter junction voltage values $V_{be1}$ and $V_{be2}$ each having a negative temperature coefficient, the feedback means including a fourth resistor coupled between the emitter of the second transistor and a node between the second and third resistors and a comparator amplifier having one input connected to the emitter of the first transistor, a second input connected to the node between the second and third resistors and an output coupled to the reference voltage node, the output of the comparator amplifier biasing the first and second transistors conductive so as to establish the voltage value $V_{be1}$ across the second resistor resulting in a voltage across the fourth resistor that is equal to the value $V_{be2}-V_{be1}$ having a positive temperature coefficient, whereby the currents through the second and third resistors establish a voltage across the fourth resistor having a value $K_1V_{be1}+K_2(V_{be2}-V_{be1})$ where $K_1$ and $K_2$ are scaling factors determined by the second, third and fourth resistors, the sum of the voltages across the second and third resistors at the reference voltage node comprising the regulated output voltage $V_R$.

* * * * *